US009073313B2

(12) United States Patent
Ito

(10) Patent No.: US 9,073,313 B2
(45) Date of Patent: Jul. 7, 2015

(54) LIQUID EJECTION APPARATUS

(71) Applicant: BROTHER KOGYO KABUSHIKI KAISHA, Nagoya-shi, Aichi-ken (JP)

(72) Inventor: Takashi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,237

(22) Filed: Mar. 28, 2013

(65) Prior Publication Data

US 2013/0314466 A1 Nov. 28, 2013

(30) Foreign Application Priority Data

May 23, 2012 (JP) ..... 2012-117952

(51) Int. Cl.

| | |
|---|---|
| ***B41J 29/393*** | (2006.01) |
| ***B41J 2/045*** | (2006.01) |
| ***B41J 2/14*** | (2006.01) |
| ***B41J 2/155*** | (2006.01) |
| ***B41J 2/165*** | (2006.01) |

(52) U.S. Cl.

CPC ..... *B41J 2/04566* (2013.01); *B41J 2/14209* (2013.01); *B41J 2/155* (2013.01); *B41J 2/16508* (2013.01); *B41J 2/16585* (2013.01)

(58) Field of Classification Search

USPC ..... 347/9, 14, 17, 19, 101, 5

See application file for complete search history.

(56) References Cited

U.S. PATENT DOCUMENTS

| | | | | |
|---|---|---|---|---|
| 7,878,616 | B2 * | 2/2011 | Hiraoka | 347/19 |
| 8,622,538 | B2 * | 1/2014 | Miyakoshi et al. | 347/101 |

FOREIGN PATENT DOCUMENTS

| | | | |
|---|---|---|---|
| JP | 2003-285446 | A | 10/2003 |
| JP | 2003-334962 | A | 11/2003 |
| JP | 2008-120101 | A | 5/2008 |

* cited by examiner

*Primary Examiner* — Lam Nguyen

(74) *Attorney, Agent, or Firm* — Merchant & Gould PC

(57) ABSTRACT

A liquid ejection apparatus including: a head having an ejection face having ejection openings opposed to an ejection space; a capping mechanism including: a facing portion capable of facing the ejection face; and a space definer configured to define the ejection space with the facing portion and the ejection face, the capping mechanism being switchable between a defining state and an open state; a humid-air supplier configured to perform a humidifying operation for supplying humid air into the ejection space; a sensor portion configured to sense temperature and/or humidity near the head; and a controller configured to, when the humidifying operation performed by the humid-air supplier is discontinued, adjust a next humidifying operation based on at least one of the temperature and the humidity sensed within a period extending from the discontinuation of the humidifying operation to the next humidifying operation.

11 Claims, 9 Drawing Sheets

FIG.9

| TEMPERATURE T(℃) | HUMIDITY H(%) | COEFFICIENT |
|---|---|---|
| T<5 | H<30 | 0.06 |
| | 30≦H<60 | 0.04 |
| | 60≦H | 0.02 |
| 5≦T<18 | H<30 | 0.08 |
| | 30≦H<60 | 0.06 |
| | 60≦H | 0.04 |
| 18≦T<25 | H<30 | 0.1 |
| | 30≦H<60 | 0.08 |
| | 60≦H | 0.06 |
| 25≦T<33 | H<30 | 0.12 |
| | 30≦H<60 | 0.1 |
| | 60≦H | 0.08 |
| 33≦T | H<30 | 0.14 |
| | 30≦H<60 | 0.12 |
| | 60≦H | 0.1 |

LIQUID EJECTION APPARATUS

CROSS REFERENCE TO RELATED APPLICATION

The present application claims priority from Japanese Patent Application No. 2012-117952, which was filed on May 23, 2012, the disclosure of which is herein incorporated by reference in its entirety.

BACKGROUND OF THE INVENTION

1. Field of the Invention

The present invention relates to a liquid ejection apparatus configured to eject liquid such as ink.

2. Description of the Related Art

There is known a liquid ejection apparatus in which a space near ejection openings of a recording head is enclosed with a cap when no printing is performed, and water vapor is supplied into this space from a water tank to humidify the space.

SUMMARY OF THE INVENTION

Incidentally, when a humidifying operation is performed in a liquid ejection apparatus, the humidifying operation may be discontinued in response to receipt of a recording command or turn-off of the apparatus. When a next humidifying operation is performed without consideration of the discontinuation in this case, the humidification becomes not enough by the discontinuation, leading to increase in viscosity of liquid in ejection openings of a liquid ejection head. For example, in a case where liquid adheres to positions near the ejection openings, the liquid in the ejection openings is deprived of water components by residual dried liquid. The increase in viscosity of the liquid in the ejection openings may lead to deterioration of ejection characteristics.

This invention has been developed to provide a liquid ejection apparatus capable of reducing increase in viscosity of liquid in ejection openings even in a case where a humidifying operation is discontinued.

The present invention provides a liquid ejection apparatus, comprising: a liquid ejection head comprising an ejection face that comprises a plurality of ejection openings for ejecting liquid, an ejection space being opposed to the plurality of ejection openings; a capping mechanism comprising: a facing portion capable of facing the ejection face; and a space definer configured to define the ejection space with the facing portion and the ejection face such that the ejection space is substantially isolated from an outside space, the capping mechanism being switchable between a defining state in which the ejection space is substantially isolated from the outside space and an open state in which the ejection space is open to the outside space; a humid-air supplier configured to perform a humidifying operation for supplying humid air into the ejection space when the capping mechanism is in the defining state; a sensor portion configured to sense at least one of temperature and humidity in a vicinity of the liquid ejection head; and a controller configured to control the liquid ejection head, the capping mechanism, and the humid-air supplier, the controller being configured to, when the humidifying operation performed by the humid-air supplier is discontinued, adjust a next humidifying operation based on at least one of the temperature and the humidity sensed within a period extending from the discontinuation of the humidifying operation to the next humidifying operation.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIG. 9 is a table for adjustment of a next humidifying operation.

DETAILED DESCRIPTION OF THE EMBODIMENT

Figure 1:
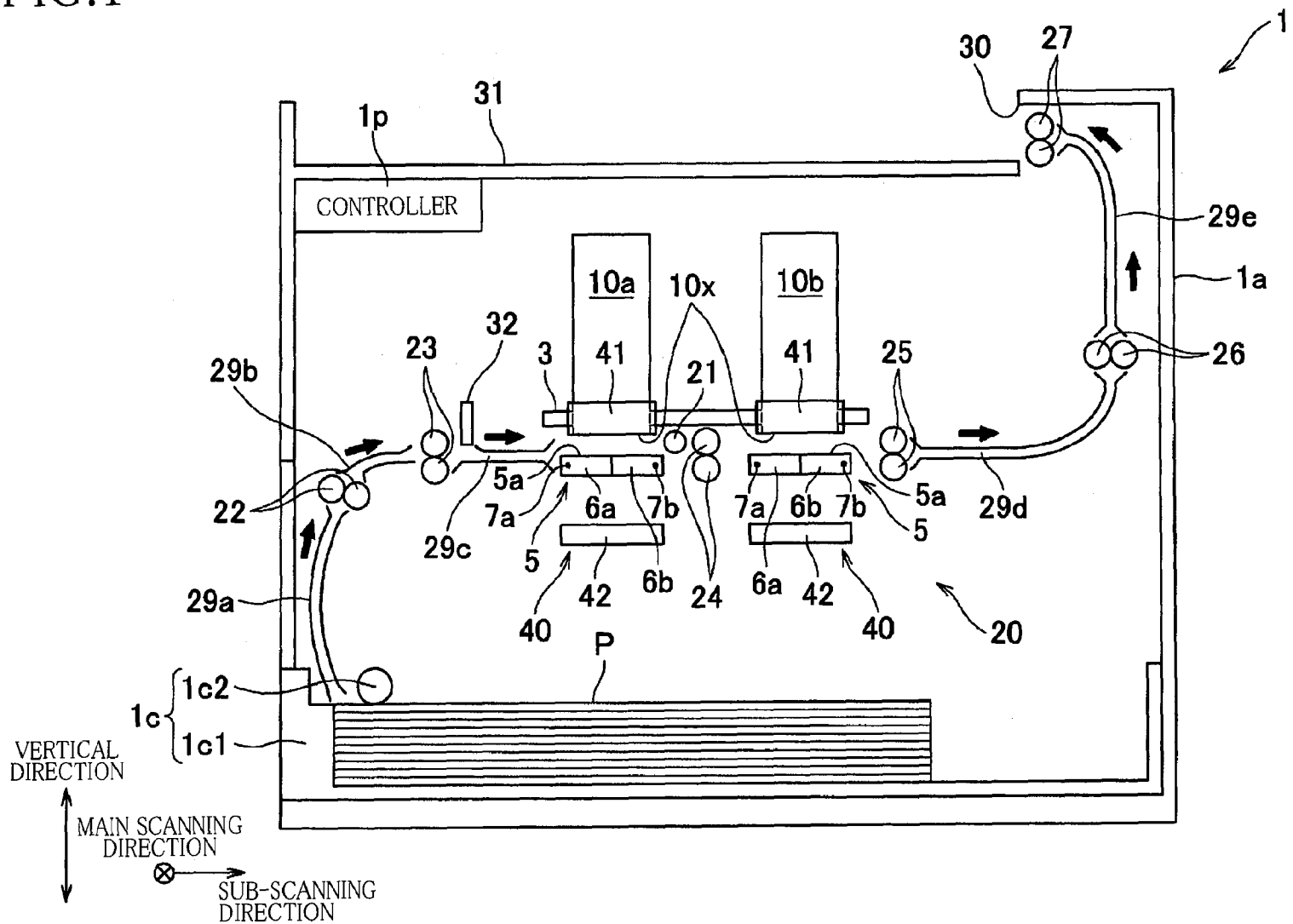
FIG. 1 is a side view generally illustrating an internal structure of an ink-jet printer according to one embodiment of the present invention.

Hereinafter, there will be described one embodiment of the present invention by reference to the drawings.

First, there will be explained, with reference to FIG. 1, an overall construction of an ink-jet printer 1 as one example of a liquid ejection apparatus according to one embodiment of the present invention.

The printer 1 includes a housing 1*a* having a rectangular parallelepiped shape. A sheet-output portion 31 is provided on a top plate of the housing 1*a*. The housing 1*a* accommodates two heads 10*a*, 10*b*, two platens 5, two capping mechanisms 40, a sheet sensor 32, a controller 1*p*, a conveyor mechanism 20, a sheet-supply unit 1*c*, a humidifying mechanism 50 (see FIG. 6) as one example of a humid-air supplier, and other similar devices and components. Formed in an inner space of the housing 1*a* is a conveyance path that extends from the sheet-supply unit 1*c* to the sheet-output portion 31. A recording medium in the form of a sheet P is conveyed through this conveyance path along bold arrows illustrated in FIG. 1.

The heads 10*a*, 10*b* have the same structure as each other and each is a line head generally having a rectangular parallelepiped shape elongated in a main scanning direction that is perpendicular to a sheet surface of FIG. 1. Each of the heads 10*a*, 10*b* has a lower face as an ejection face 10*x* in which a multiplicity of ejection openings 14*a* are formed (see FIGS. 3 and 4). The heads 10*a*, 10*b* respectively eject pretreatment liquid and black ink (hereinafter may be collectively referred to as "liquid") from the ejection openings 14*a*. The pretreatment liquid has a property of coagulating pigments of the ink to prevent spread and strike-through of the ink and improve color development and quick drying of the ink, for example. The pretreatment liquid may contain polyvalent metal salt such as cationic high polymer and magnesium salt.

The heads 10*a*, 10*b* are arranged spaced apart from each other in a sub-scanning direction (that is perpendicular to the main scanning direction and a vertical direction) and supported by the housing 1*a* via a holder 3. The holder 3 supports the heads 10*a*, 10*b* such that spaces suitable for image recording (or image forming) are respectively formed between the ejection faces 10*x* and support faces 5*a* of the respective platens 5. The holder 3 also supports space definers 41 provided respectively for the heads 10*a*, 10*b*. Each of the space definers 41 encloses outer sides of a corresponding one of the ejection faces 10*x*, and constitutes a corresponding one of the capping mechanisms 40.

Figure 7:
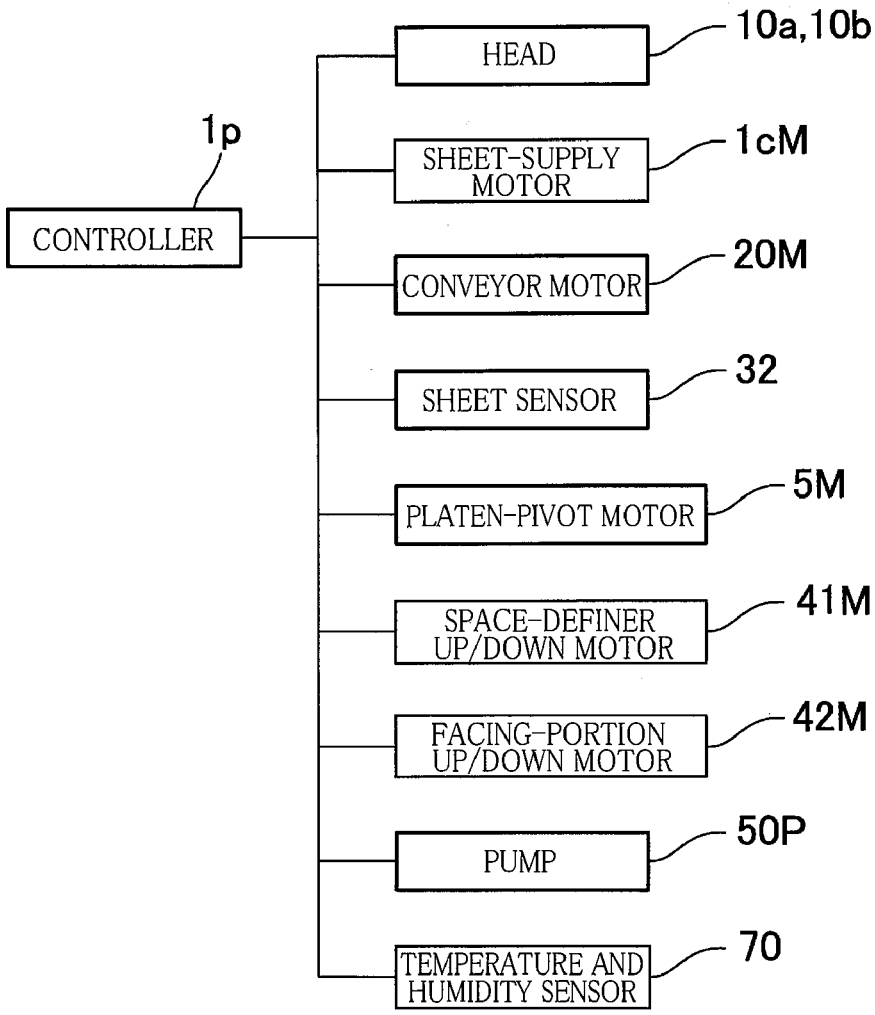
FIG. 7 is a block diagram illustrating an electric configuration of the printer.

The platens 5 are provided respectively for the heads 10*a*, 10*b* and arranged under the respective heads 10*a*, 10*b*. Each of the platens 5 is constituted by two plates 6*a*, 6*b*. The plates 6*a*, 6*b* are pivotable respectively about shafts 7*a*, 7*b*. Under control of the controller 1*p*, each of the platens 5 is pivoted by driving of a platen-pivot motor 5M (see FIG. 7). Each platen 5 can be located at a support-face forming position (indicated in FIG. 1) and an open position (indicated in FIG. 5B). At the support-face forming position, the plates 6*a*, 6*b* extend horizontally with their distal ends facing each other, so that the two plates 6*a*, 6*b* constitute a support face 5*a* for supporting the sheet P. The support face 5*a* is flat as a whole and faces the ejection face 10*x* with a predetermined space therebetween. At the open position, the plates 6*a*, 6*b* extend downward. The platens 5 are located at the support-face forming position in the recording and located at the open position in a humidifying operation.

The capping mechanisms 40 are provided respectively for the heads 10*a*, 10*b*. Each of the capping mechanisms 40 is constituted by a facing portion 42 and a corresponding one of the space definers 41. The facing portion 42 is a rectangular plate one size larger than the space definer 41 and generally equal in size to a corresponding one of the platens 5. The facing portions 42 are arranged under the respective heads 10*a*, 10*b*. Each of the facing portions 42 is formed of a material such as glass or metal having a property of not or hardly absorbing water. The space definer 41 is formed of an elastic material such as rubber. The structure and operations of the capping mechanisms 40 will be explained later in detail.

The conveyor mechanism 20 includes roller pairs 22, 23, 24, 25, 26, 27 and guides 29*a*, 29*b*, 29*c*, 29*d*, 29*e*, and an intermediate roller 21. The roller pairs 22-27 are arranged in this order from an upstream side in the conveying direction to form the conveyance path. One roller of each of the roller pairs 23-27 is a drive roller that is coupled to a conveyor motor 20M (see FIG. 7). Under the control of the controller 1*p*, the drive roller is rotated by driving of the conveyor motor 20M. The other roller of each of the roller pairs 23-27 is a driven roller that is rotated by the rotation of the drive roller. The guides 29*a*-29*e* are arranged in this order from the upstream side in the conveying direction to form the conveyance path. Each of the guides 29*a*-29*e* is constituted by a pair of plates opposed to each other in their planar direction with a predetermined space therebetween. The intermediate roller 21 is disposed between the head 10*a* and the roller pair 24 on an upper side of the conveyance path. The intermediate roller 21 is a spur roller, for example. The sheet P with the pretreatment liquid landed on its face is guided by this intermediate roller 21 to the roller pair 24 such that the face of the sheet P does not come into contact with other components.

The sheet-supply unit 1*c* includes a sheet-supply tray 1*c*1 and a sheet-supply roller 1*c*2. The sheet-supply tray 1*c*1 is mountable on and removable from the housing 1*a*. The sheet-supply tray 1*c*1 is a box opening upward and can accommodate a plurality of sheets P. Under the control of the controller 1*p*, the sheet-supply roller 1*c*2 is rotated by driving of a sheet-supply motor 1*c*M (see FIG. 7) to supply an uppermost one of the sheets P stacked on the sheet-supply tray 1*c*1.

The controller 1*p* includes: a central processing unit (CPU); a read only memory (ROM), a random access memory (RAM) including a non-transitory RAM; an application specific integrated circuit (ASIC), an interface (I/F), an input/output port (I/O), and an internal timer for measuring a time. The ROM stores programs executable by the CPU, various fixed data, and other similar information. The RAM temporarily stores data, e.g., image data, required for the execution of the program. The ASIC performs, e.g., overwriting, sorting, and other similar operations for the image data (for example, a signal processing and an image processing). The I/F transmits and receives data to and from an external device such as a personal computer (PC) coupled to the printer 1. The I/O inputs and outputs sense signals of various sensors. It is noted that the program or the like executed by the CPU may execute the overwriting, sorting, and other similar operations for the image data, with the ASIC omitted.

In order to record an image on the sheet P on the basis of a recording command supplied from the external device, the controller 1*p* controls: a preliminary operation for the recording; the supplying, conveying, and discharging of the sheet P; a liquid ejecting operation performed in accordance with the conveyance of the sheet P; and other similar operations. The sheet P is supplied from the sheet-supply unit 1*c* and conveyed in the conveying direction by the roller pairs 22-27 and the guides 29*a*-29*e*. When the sheet P passes through positions just under the heads 10*a*, 10*b* (on the support face 5*a*), the controller 1*p* controls the heads 10*a*, 10*b* to eject the liquid from the ejection openings 14*a* (see FIG. 4), so that an image is formed on a face of the sheet P. The liquid ejecting operation for ejecting the liquid from the ejection openings 14*a* is performed on the basis of a sheet-leading-edge sense signal output from the sheet sensor 32. The sheet P with the image formed thereon is discharged onto the sheet-output portion 31 through an opening 30 formed in an upper portion of the housing 1*a*.

Figure 2:
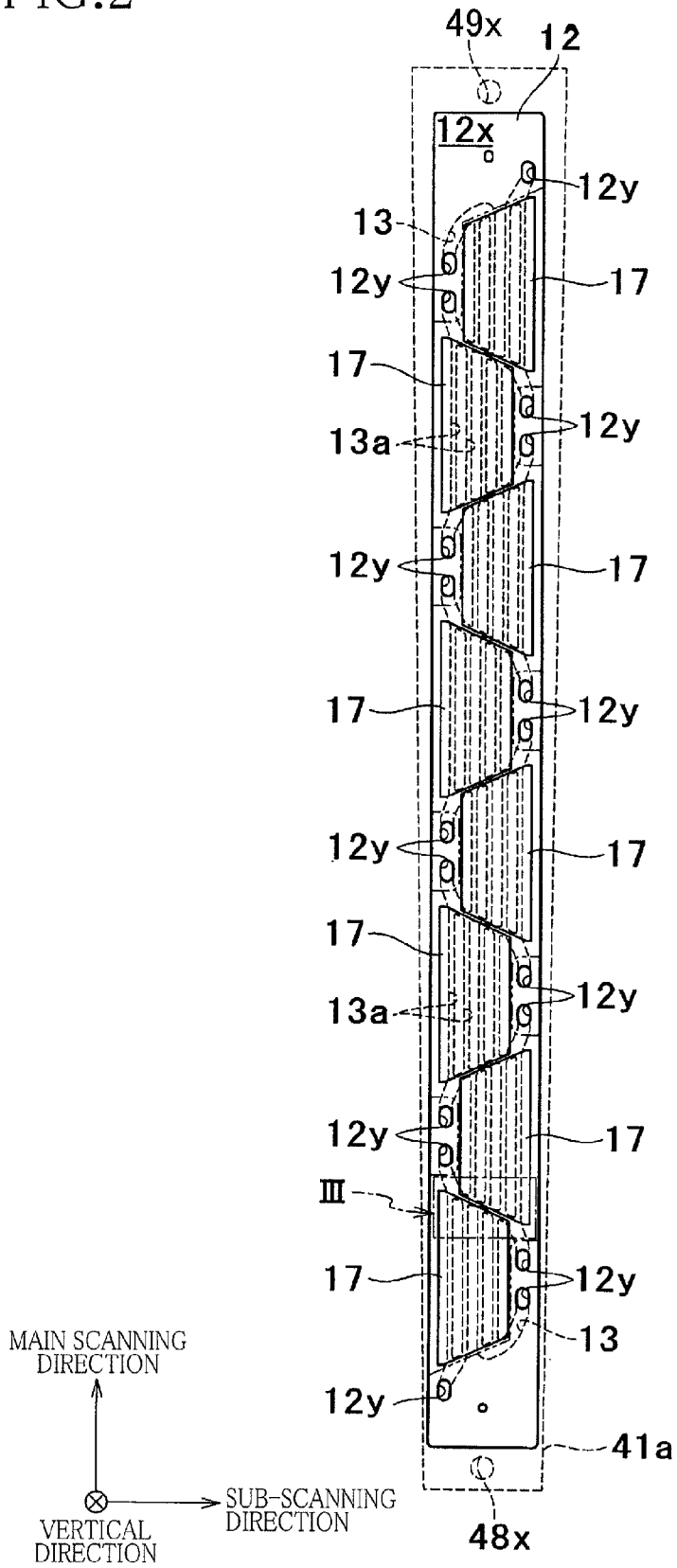
FIG. 2 is a plan view illustrating a channel unit and actuator units of the head.
Figure 3:
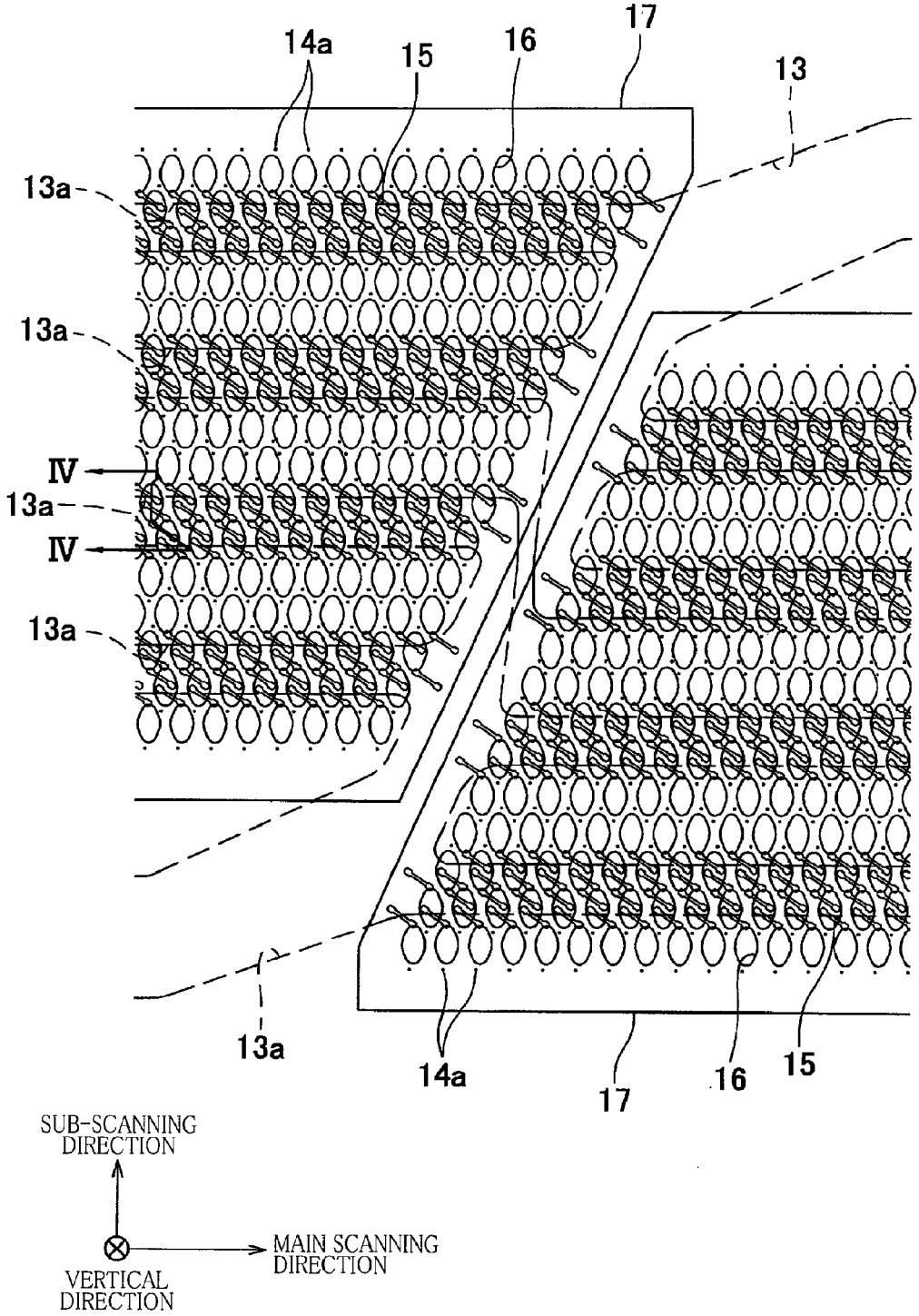
FIG. 3 is an enlarged view illustrating an area III enclosed by a one-dot chain line in FIG. 2.
Figure 4:
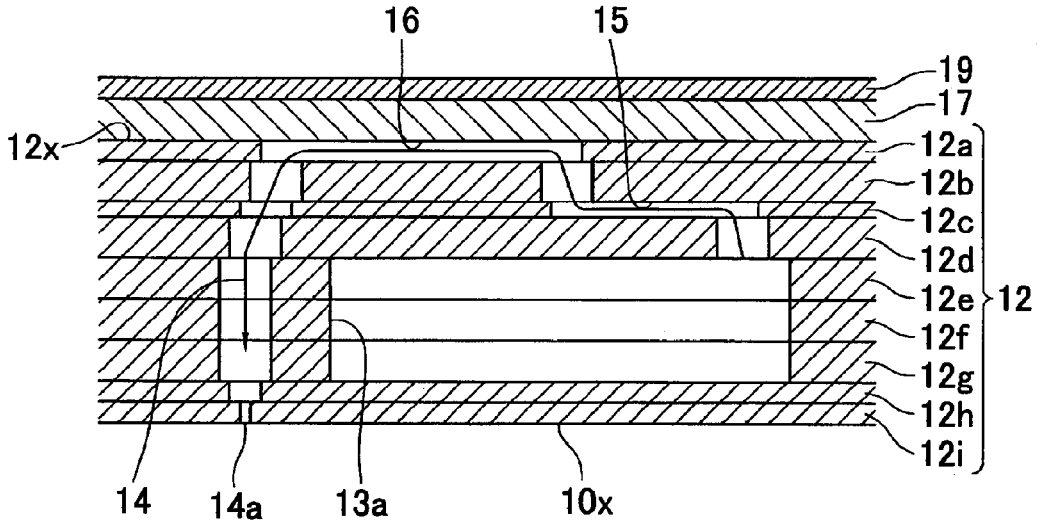
FIG. 4 is a cross-sectional view taken along line IV-IV in FIG. 3.

There will be next explained the structure of the heads 10*a*, 10*b* with reference to FIGS. 2-4. It is noted that the heads 10*a*, 10*b* have the same structure, and the following explanation is provided for one head for the sake of simplicity unless otherwise required by context. It is further noted that, in FIG. 3, pressure chambers 16 and apertures 15 are illustrated by solid lines for easier understanding purposes though these elements are located under actuator units 17 and thus should be illustrated by broken lines.

The head includes a channel unit 12, the eight actuator units 17, eight flexible printed circuits (FPCs) 19, a reservoir unit, and a circuit board.

The channel unit 12 is a stacked body constituted by nine metal plates 12*a*, 12*b*, 12*c*, 12*d*, 12*e*, 12*f*, 12*g*, 12*h*, 12*i* having generally the same size, and channels are formed in the channel unit 12. These channels include manifold channels 13, sub-manifold channels 13*a*, and individual channels 14. An upper face 12*x* of the channel unit 12 has openings 12*y*. Each of the manifold channels 13 has a corresponding one of the openings 12*y* at its one end. Each of the sub-manifold channels 13*a* is branched off from a corresponding one of the manifold channels 13 at the other end thereof. The individual channels 14 are provided respectively for the ejection openings 14*a* and each extends from an outlet of a corresponding one of the sub-manifold channels 13*a* to a corresponding one of the ejection openings 14*a* via a corresponding one of the pressure chambers 16 and a corresponding one of the apertures 15 each as a restrictor for adjusting a channel resistance. A lower face of the channel unit 12 on a back side of the upper face 12*x* is the ejection face 10*x*.

Each of the pressure chambers 16 communicates with a corresponding one of the ejection openings 14*a*. Each of the pressure chambers 16 has a generally rhombic shape. The pressure chambers 16 are arranged in matrix in the upper face 12*x* so as to form a plurality of pressure-chamber groups. Each of the pressure-chamber groups overlaps a corresponding one of the actuator units 17 when seen in the vertical direction. Openings of the respective pressure chambers 16 in each pressure-chamber group are sealed by the corresponding actuator unit 17. The ejection openings 14*a* are arranged in matrix in the ejection face 10*x* so as to overlap the actuator units 17 in the vertical direction.

As illustrated in FIG. 2, the eight actuator units 17 are fixed to the upper face 12*x* so as to be arranged in two arrays in a staggered configuration in the main scanning direction. Each of the actuator units 17 is a stacked body constituted by two piezoelectric layers each having a trapezoid shape as its outer shape. One of the two piezoelectric layers which is further from the pressure chambers 16 is sandwiched between a common electrode and individual electrodes. The common electrode is formed on a face of the piezoelectric layer which is nearer to the pressure chambers 16, and the individual electrodes are formed on a face of the piezoelectric layer which is further from the pressure chambers 16. The individual electrodes are provided respectively for the pressure chambers 16 and opposed to the pressure chambers 16. A portion of the actuator units 17 which is sandwiched between each of the individual electrodes and a corresponding one of the pressure chambers 16 functions as an individual unimorph actuator for the pressure chamber 16. The actuators are deformable independently of one another. When a drive voltage is applied to each of the actuators via a corresponding one of the FPCs 19, the actuator makes unimorph deformation to change a volume of the corresponding pressure chamber 16. This change in volume applies energy to the liquid in the pressure chamber 16, causing the liquid to be ejected from a corresponding one of the ejection opening 14*a*.

The eight FPCs 19 are connected respectively to the eight actuator units 17. Each of the FPCs 19 is fixed at its one end to a corresponding one of the actuator units 17 and fixed at the other end to the circuit board, and a driver IC is mounted on each FPC 19 between the actuator unit 17 and the circuit board. The circuit board adjusts a signal input from the controller 1*p* and outputs the adjusted signal to the driver IC through a wiring of the FPC 19. The driver IC converts this signal to a drive signal and transmits this drive signal to electrodes of the actuator units 17.

The reservoir unit has a channel including a reservoir. This channel is coupled at its one end to a cartridge, not shown, by a tube, for example, and at the other end to the channels of the channel unit 12. The reservoir temporarily stores the liquid supplied from the cartridge. Protruding portions and recessed portions are formed on and in a lower face of the reservoir unit. Distal end faces of the respective protruding portions are fixed to the upper face 12*x* so as to overlap the actuator units 17. Channels connected to the reservoir are open in the distal end faces of the respective protruding portions and connected to the respective openings 12*y*. The recessed portions are opposed to the upper face 12*x*, faces of the actuator units 17, and faces of the FPCs 19 with a small space therebetween.

Figure 5A:
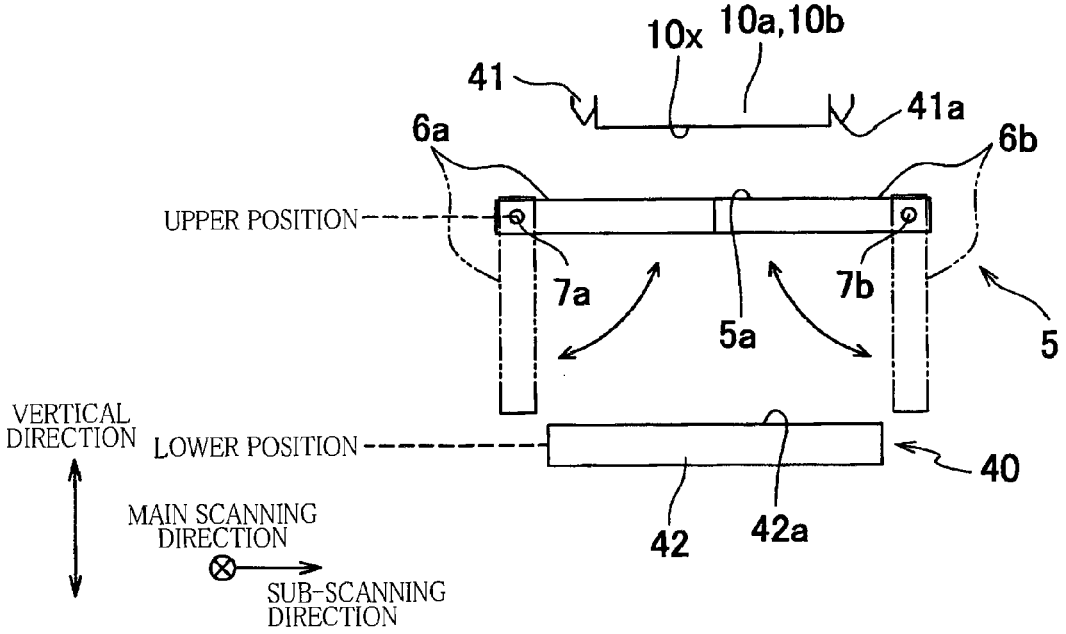
FIGS. 5A and 5B are views for explaining operations of capping mechanisms and platens.
Figure 5B:
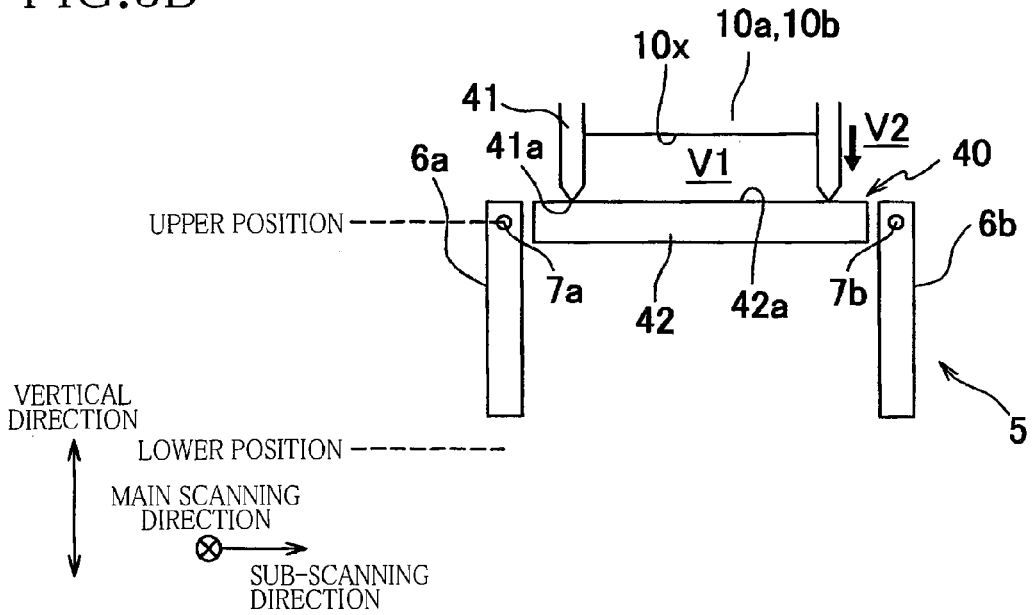
Figure 6:
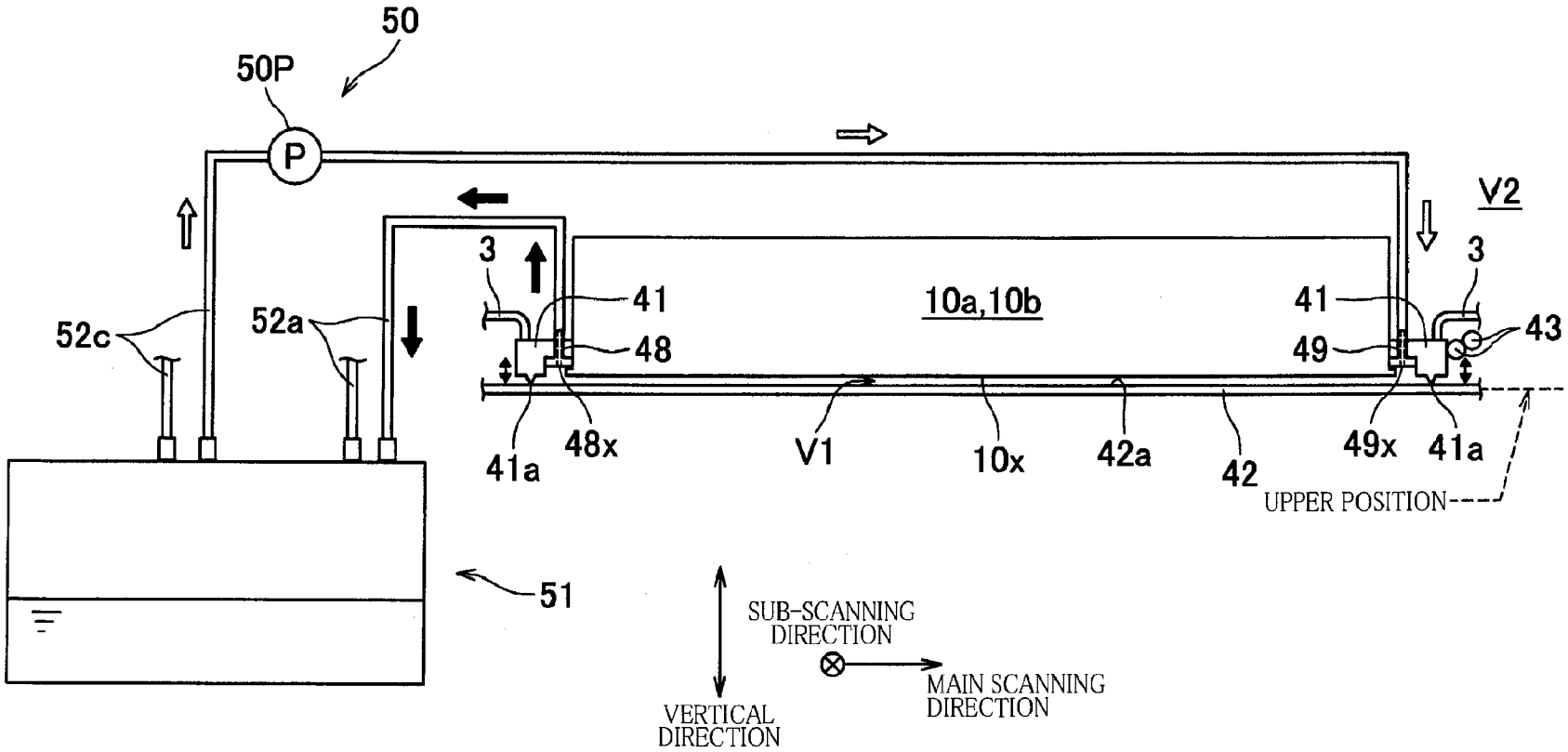
FIG. 6 is a view for explaining a humidifying operation.

There will be next explained, with reference to FIGS. 5 and 6, constructions and operations of the capping mechanisms 40 and the humidifying mechanism 50. It is noted that the capping mechanisms 40 have the same structure, and the following explanation is provided for one head for the sake of simplicity unless otherwise required by context.

The space definer 41 of the capping mechanism 40 has a portion fixed to side faces of the head in its entire perimeter and a portion movable along the side faces. The space definer 41 encloses the ejection face 10*x* to define an ejection space V1 between the ejection face 10*x* and the facing portion 42 (that is, the ejection space V1 is opposed to the ejection face 10*x*). The space definer 41 is connected to one of a plurality of gears 43 and elevated and lowered by driving of a space-definer up/down motor 41M (see FIG. 7) under the control of the controller 1*p*. The facing portion 42 is elevated and lowered by driving of a facing-portion up/down motor 42M (see FIG. 7) under the control of the controller 1*p*. The facing portion 42 is located at a lower position in the recording and located at an upper position in the humidifying operation. A distance between an upper face 42*a* of the facing portion 42 and the ejection face 10*x* when the facing portion 42 is located at the upper position is equal to that between the support face 5*a* and the ejection face 10*x* in the recording.

A state of the capping mechanism 40 is switchable between (i) a defining state (see FIGS. 5B and 6) in which the space definer 41 substantially isolates the ejection space V1 from an outside space V2 and (ii) an open state (see FIGS. 1 and 5A) in which the space definer 41 does not isolate the ejection space V1 from an outside space V2 such that the ejection space V1 is open to the outside space V2. For example, when switching the capping mechanism 40 to the defining state as illustrated in FIG. 5B, the controller 1*p* moves the platen 5 and the facing portion 42 respectively to the open position and the upper position and lowers the space definer 41. As a result, a distal end 41*a* of the space definer 41 is held in contact with the upper face 42*a*, so that the ejection space V1 is defined between the upper face 42*a* and the ejection face 10*x*. In this state, the space definer 41 encloses the ejection openings 14*a* with the facing portion 42 and isolates the ejection space V1 from the outside space V2.

As illustrated in FIG. 6, the humidifying mechanism 50 includes a tank 51, two tubes 52*a*, two tubes 52*c*, and two pumps 50P. The tank 51 stores humidification liquid such as water and water with preservatives. The two tubes 52*a* connect between the tank 51 and joints 48 of the respective heads 10*a*, 10*b*. The two tubes 52*c* connect between the tank 51 and joints 49 of the respective heads 10*a*, 10*b*. The joints 48, 49 are provided for each of the heads 10*a*, 10*b* and respectively arranged on one and the other ends of the head in the main scanning direction. The joints 48, 49 are mounted on each space definer 41 to establish communication between the ejection space V1 and the outside space V2. The pumps 50P are provided on the respective tubes 52*c*.

In the humidifying operation, the controller 1*p* drives each pump 50P, with the capping mechanism 40 kept in the defining state. As a result, air in the ejection space V1 is collected from an opening 48*x* of a lower face of the joint 48 and delivered through the tube 52*a* into the tank 51. The air delivered into the tank 51 is humidified by the humidification liquid stored in the tank 51 and then delivered through the tube 52*c* into the ejection space V1 through an opening 49*x* of a lower face of the joint 49. Accordingly, the humidifying operation is an operation for supplying the humid air into the ejection space V1 (i.e., the capping mechanism 40) when the capping mechanism 40 is in the defining state. In FIG. 6, bold arrows indicate a flow of air before the humidification, while white arrows indicate a flow of the humid air. The humidifying operation reduces increase in viscosity of the liquid in the ejection openings 14*a*.

Figure 8:
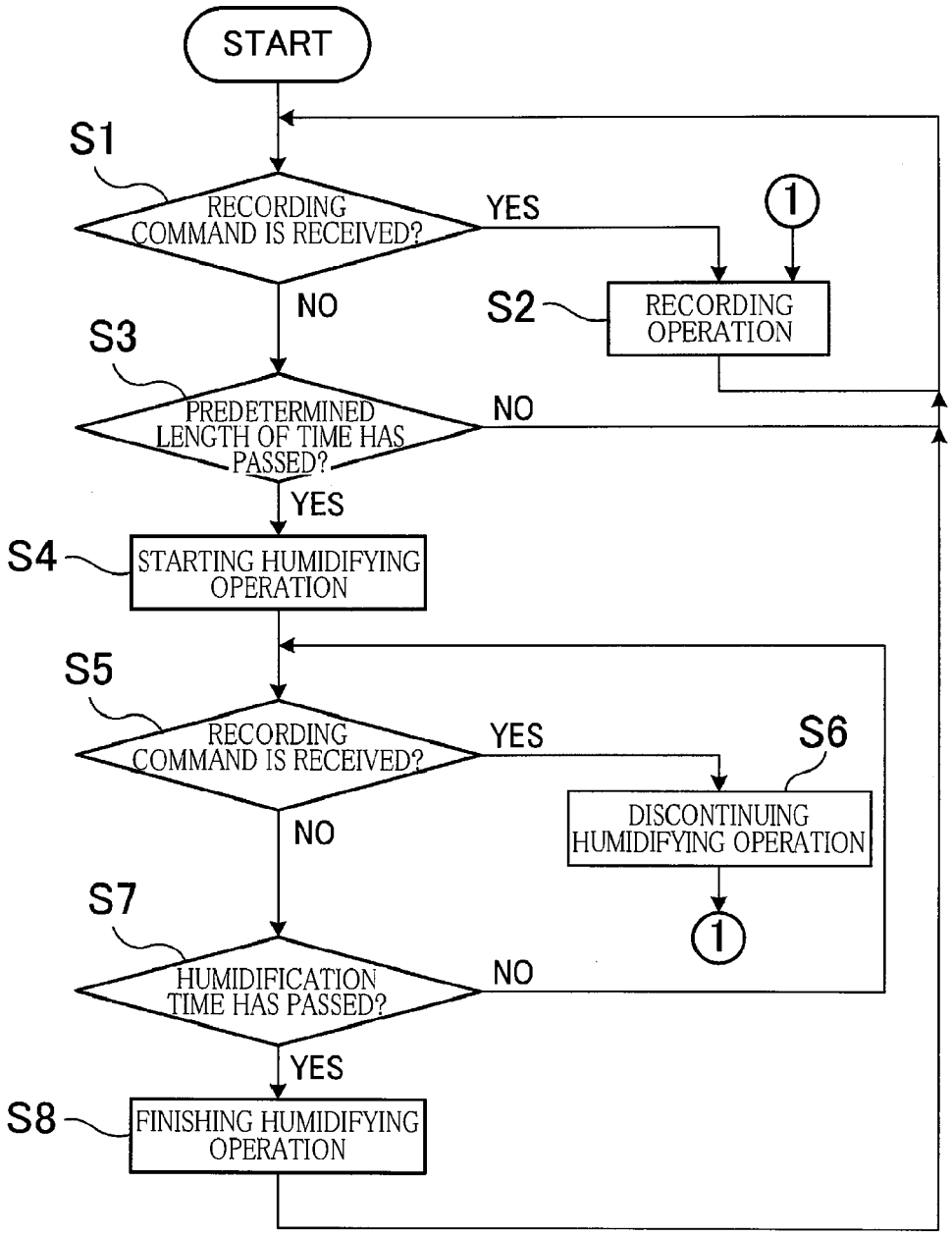
FIG. 8 is a flow chart illustrating a humidifying operation controlled by the controller.

There will be next explained, with reference to FIG. 8, a flow of processings executed by the controller 1*p* for the humidifying operation. Here, processings for a plurality of recording jobs will be explained. It is noted that since the same processings are executed for the heads 10*a*, 10*b*, the following explanation is provided for one head for the sake of simplicity unless otherwise required by context.

This flow begins with S1 where the controller 1*p* determines whether a recording command is received or not. When the recording command is received (S1: YES), the controller 1*p* at S2 controls the head and the conveyor mechanism 20 to perform a recording operation based on the recording command. The head and the conveyor mechanism 20 are operated in accordance with the sheet-leading-edge sense signals output from the sheet sensor 32. Upon completion at S2, this flow returns to S1. When the recording command is not received (S1: NO), the controller 1*p* at S3 determines whether a predetermined length of time has passed or not from the preceding receipt of the recording command. When the predetermined length of time has not passed (S3: NO), this flow returns to S1. When the predetermined length of time has passed (S3: YES), the controller 1*p* at S4 controls the platen 5, the capping mechanism 40, and the humidifying mechanism 50 to start the humidifying operation.

The controller 1*p* at S4 determines details of the current humidifying operation first. The details of the humidifying operation such as a humidification time and an amount of the humid air supplied into the ejection space V1 per unit time are adjusted by various parameters including: a time elapsed from the preceding humidifying operation; changes in temperature and humidity from the preceding humidifying operation; and a type of the liquid to be ejected. When the preceding humidifying operation is finished at the end of the determined humidification time, the controller 1*p* determines a predefined length of time (e.g., three minutes) as a current humidification time. On the other hand, when the preceding humidifying operation is stopped in the middle of the operation, that is, when the preceding humidifying operation is discontinued or interrupted and finished in a length of time shorter than the determined humidification time, the controller 1*p* determines, as the current humidification time, a length of time that is obtained by adding, to the predefined length of time, a length of time adjusted corresponding to a remaining humidification time for which the humidification should have been performed if the preceding humidifying operation had not been discontinued (i.e., a remaining time). This remaining humidification time is obtained by subtracting a length of time for which the humidification has been performed, from an original or predefined humidification time for which the humidifying operation is originally planned to be performed. In addition to the determination of the details of the humidifying operation, the controller 1*p* determines whether the capping mechanism 40 is in the defining state or not. When the capping mechanism 40 is not in the defining state, the controller 1*p* moves the platen 5 and the facing portion 42 respectively to the open position and the upper position and lowers the space definer 41 to bring the space definer 41 into contact with the facing portion 42. When the pump 50P is driven with the capping mechanism 40 being in the defining state, the humid air is supplied into the ejection space V1.

Upon completion at S4, the controller 1*p* at S5 determines whether a recording command is received or not. When the recording command is received (S5: YES), the controller 1*p* at S6 stops driving the pump 50P to discontinue the humidifying operation. Upon completion at S6, this flow returns to S2. Before executing the processing at S2, the controller 1*p* switches the capping mechanism 40 to the open state. That is, the controller 1*p* moves the facing portion 42 to the lower position, elevates the space definer 41, and moves the platen 5 to the support-face forming position. The controller 1*p* also stores a remaining time in the current humidifying operation.

When the recording command is not received (S5: NO), the controller 1*p* determines at S7 whether the humidification time has passed from the start of the humidifying operation or not. When the humidification time has not passed (S7: NO), this flow returns to S5. When the humidification time has passed (S7: YES), the controller 1*p* at S8 stops driving the pump 50P to finish the humidifying operation. Upon completion at S8, this flow returns to S1. At this time the controller 1*p* keeps the capping mechanism 40 in the defining state, and then switches the capping mechanism 40 to the open state before executing the processing at S2. Also, in a case where the remaining time is stored in, e.g., the RAM at this time, the controller 1*p* resets data (that is, the controller 1*p* sets the remaining time to zero).

Not only when the recording command is received (S5: YES) but also when a power source of the printer 1 is turned off, the controller 1*p* at S6 discontinues the humidifying operation. When the humidifying operation is discontinued, the controller 1*p* adjusts the next humidifying operation in the following manner.

In this adjustment, the controller 1*p* uses sense signals output from temperature and humidity sensors 70 (see FIG. 7) as one example of a sensor portion. The temperature and humidity sensors 70 are provided respectively on the heads 10*a*, 10*b* to sense both temperature and humidity near the respective heads 10*a*, 10*b*. Each of the temperature and humidity sensors 70 may be fixed to the ejection face 10*x*, for example. The sense signal output from the temperature and humidity sensor 70 is obtained by the controller 1*p* every preset length of time (e.g., one minute).

The controller 1*p* calculates an additional time that is to be added to the next humidifying operation. Specifically, the controller 1*p* calculates this additional time on the basis of (i) the temperature and the humidity near the heads 10*a*, 10*b* within a period after the humidifying operation is discontinued and before the next humidifying operation is performed (more specifically, a period extending from the discontinuation of the humidifying operation to a start of the next humidifying operation) and (ii) the remaining humidification time for which the humidification should have been performed if the preceding humidifying operation had not been discontinued (i.e., the remaining time). For example, in a case where the original humidification time (i.e., a length of time originally planned) for the discontinued humidifying operation is three minutes, and the humidifying operation is discontinued when two minutes have passed after the start of the humidifying operation, the remaining time one minute (=3−2).

The controller 1*p* refers to a table illustrated in FIG. 9 stored in the ROM upon every obtainment of the sense signal output from the temperature and humidity sensor 70 in the above-described period. The table stores a relationship between a coefficient for adjustment and the temperature and the humidity. The controller 1*p* obtains a coefficient based on the temperature and the humidity indicative of the sense signal. Each obtainment, the controller 1*p* adds a newly obtained coefficient to a total of coefficients previously obtained, to obtain a cumulative total value of the coefficients. For example, in a case where the cumulative value is 0.8, the additional time is 0.8 minutes (=one minute (the remaining time)×0.8 (the cumulative value)).

In the table, the coefficient is set to increase with increase in the temperature near the heads 10*a*, 10*b* and with decrease in the humidity near the heads 10*a*, 10*b*. Thus, the additional time increases with increase in easiness of drying (i.e., high-temperature and low-humidity conditions).

The ROM further stores an upper limit value (as one example of an upper limit time) of the additional time (e.g., twelve minutes).

When the additional time is equal to or shorter than the upper limit time, the controller 1*p* sets the humidification time for the next humidifying operation, at a length of time obtained by adding the additional time to the original humidification time for the next humidifying operation (e.g., three minutes). For example, in a case where the upper limit time is twelve minutes, the additional time is 0.8 minutes, and the original humidification time for the next humidifying operation is three minutes, the additional time is equal to or shorter than the upper limit time. Thus, the controller 1*p* sets the humidification time for the next humidifying operation at 3.8 minutes (=three minutes (the original humidification time)+ 0.8 minutes (the additional time)).

On the other hand, when the additional time is longer than the upper limit time, the controller 1*p* sets the humidification time for the next humidifying operation, at a total time that is a length of time obtained by adding the upper limit time to the original humidification time for the next humidifying operation, and the controller 1*p* adjusts an amount of the humid air supplied into the ejection space V1 per unit time (hereinafter may be referred to as "unit-time supply amount") in the next humidifying operation in the following manner. That is, the controller 1*p* sets the unit-time supply amount for the next humidifying operation at a value obtained by adding an original or predefined unit-time supply amount (by which the humid air should have been supplied if the humidifying operation had not been discontinued) for the next humidifying operation to a value obtained by dividing a difference between an amount of the humid air to be supplied within the additional time and an amount of the humid air to be supplied within the upper limit time, by the total time. For example, in a case where the upper limit time is twelve minutes, the additional time is fifteen minutes, and the original humidification time for the next humidifying operation is three minutes, the additional time (fifteen minutes) is greater than the upper limit time (twelve minutes). Thus, the controller 1*p* sets the humidification time (i.e., the total time) for the next humidifying operation at fifteen minutes (=three minutes (the original humidification time)+ twelve minutes (the upper limit time)). The controller 1*p* also adjusts the unit-time supply amount for the next humidifying operation in the following manner. For example, in a case where the original unit-time supply amount for the next humidifying operation (i.e., an amount of the humid air to be supplied into the ejection space V1 per unit time (i.e., one second)) is 10 ml, an amount of the humid air to be supplied into the ejection space V1 within the additional time (i.e., fifteen minutes) is 9000 ml, and an amount of the humid air to be supplied into the ejection space V1 within the upper limit time (i.e., twelve minutes) is 7200 ml, the controller 1*p* sets the unit-time supply amount for the next humidifying operation at an amount (12 ml=10 ml+2 ml) obtained by adding the original unit-time supply amount for the next humidifying operation (i.e., 10 ml) to a value (i.e., 2 ml) obtained by dividing the difference (1800 ml (=9000 ml−7200 ml)) by the total time (i.e., fifteen minutes=900 seconds).

The original humidification time and the original unit-time supply amount may be determined on the basis of the temperature and the humidity near the heads 10*a*, 10*b*, a time for which the capping mechanism 40 is kept in the open state, and the like. For example, the controller 1*p* may increase the original humidification time and/or the original unit-time supply amount with the increase in the easiness of drying (i.e., the high-temperature and low-humidity conditions).

In a case where a plurality of humidifying operations are successively discontinued, the controller 1*p* adjusts, as a next humidifying operation, a humidifying operation that follows the last one of the plurality of humidifying operations, on the basis of a cumulative adjustment amount that is a cumulative total of a plurality of adjustment amounts respectively for periods related to the respective discontinuations of the plurality of humidifying operations. For example, in a case where the humidifying operation is discontinued three times in a row, the controller 1*p* adds three additional times together each calculated for one humidifying operation on the basis of the table illustrated in FIG. 9, and the controller 1*p* sets the obtained value as a cumulative additional time. The controller 1*p* does not change the upper limit time. When the cumulative additional time is equal to or shorter than the upper limit time, the controller 1*p* sets the humidification time for the next humidifying operation at a length of time obtained by adding the cumulative additional time to the original humidification time for the next humidifying operation. On the other hand, when the cumulative additional time is longer than the upper limit time, the controller 1*p* sets the humidification time for the next humidifying operation at the total time obtained by adding the upper limit time to the original humidification time for the next humidifying operation and adjusts the unit-time supply amount for the next humidifying operation. Regarding this adjustment, read the wording "additional time" in the above-described explanation as "cumulative additional time".

The controller 1*p* further adjusts the next humidifying operation for each of the heads 10*a*, 10*b* according to the type of the liquid to be ejected from the ejection openings 14*a*. In general, the pretreatment liquid not containing pigments is less easily dried than the ink containing pigments. For the head 10*a* configured to eject the pretreatment liquid, accordingly, the controller 1*p* sets the additional time at a value obtained by multiplying the additional time calculated on the basis of the table illustrated in FIG. 9 by a value less than one or calculates the additional time using a table different from the table illustrated in FIG. 9 and storing coefficient values each less than a corresponding one of the coefficient values stored in the table illustrated in FIG. 9.

In a case where the humidifying operation is discontinued in response to receipt of the recording command (S5: YES, S6), the controller 1*p* adjusts the next humidifying operation such that at least one of the humidification time and the unit-time supply amount increases with increase in a speed (i.e., a conveyance speed) at which the sheet P is conveyed along the conveyance path in the recording operation (S2). In other words, the faster the conveyance speed, the longer or larger at least one of the humidification time and the unit-time supply amount is. For example, the ROM stores a reference value of the conveying speed and a plurality of coefficients that increase with increase in a difference between the conveying speed (> the reference value) and the reference value, and when the conveying speed is faster than the reference value, the controller 1*p* sets the additional time at a value obtained by multiplying the additional time calculated on the basis of the table illustrated in FIG. 9 by a corresponding one of the coefficients. Alternatively, the ROM stores a reference value of the conveying speed and a plurality of tables similar to the table in FIG. 9, related to differences between the conveying speed (> the reference value) and the reference value, and storing coefficients that increase with increase in the difference, and when the conveying speed is faster than the reference value, the controller 1*p* calculates the additional time using one of the tables which corresponds to the difference.

In the printer 1 according to the present embodiment described above, the controller 1*p* adjusts the next humidifying operation on the basis of the temperature and the humidity near the heads 10*a*, 10*b* to make up for insufficient humidification. Thus, even in the case where the humidifying operation is discontinued, it is possible to reduce the increase in viscosity of the liquid in the ejection openings 14*a*.

In addition, both of the temperature and the humidity near the heads 10*a*, 10*b* are used, making it possible to more reliably reduce the increase in viscosity of the liquid in the ejection openings 14*a*.

In the case where a plurality of humidifying operations are successively discontinued, the controller 1*p* adjusts the next humidifying operation that follows the last one of the plurality of humidifying operations, on the basis of the cumulative adjustment amount that is the cumulative total of the plurality of adjustment amounts respectively for the periods related to the respective discontinuations of the plurality of humidifying operations. This configuration enables more effective adjustment, making it possible to more reliably reduce the increase in viscosity of the liquid in the ejection openings 14*a*.

The controller 1*p* further adjusts the next humidifying operation for each of the heads 10*a*, 10*b* according to the type of the liquid to be ejected from the ejection openings 14*a*. The easiness of drying of the liquid varies with types of the liquid. Thus, the adjustment is performed according to the type of the liquid as described above, thereby efficiently reducing the increase in viscosity of the liquid in the ejection openings 14*a* of each of the heads 10*a*, 10*b*.

The controller 1*p* adjusts the humidification time and the unit-time supply amount for the next humidifying operation. This configuration enables more effective adjustment, making it possible to more reliably reduce the increase in viscosity of the liquid in the ejection openings 14*a*.

When the additional time is longer than the upper limit time, the controller 1*p* sets the humidification time for the next humidifying operation at the total time obtained by adding the upper limit time to the original humidification time for the next humidifying operation and sets the unit-time supply amount for the next humidifying operation at the value obtained by adding the original unit-time supply amount for the next humidifying operation to the value obtained by dividing the difference between the amount of the humid air to be supplied within the additional time and the amount of the humid air to be supplied within the upper limit time, by the total time. This configuration makes it possible to reduce the humidification time and the increase in viscosity of the liquid in the ejection openings 14*a*.

In a case where the humidifying operation is discontinued in response to receipt of the recording command (S5: YES, S6), the controller 1*p* adjusts the next humidifying operation such that at least one of the humidification time and the unit-time supply amount increases with increase in the conveyance speed of the sheet P conveyed along the conveyance path in the recording operation (S2). A high conveying speed produces a fast air flow near the ejection openings 14*a* in the conveyance of the sheet P, thereby promoting the increase in viscosity of the liquid in the ejection openings 14*a*. To solve this problem, the controller 1*p* increases the humidification time and/or the amount of the humid air with the increase in the conveying speed as described above in the present embodiment, making it possible to more reliably reduce the increase in viscosity of the liquid in the ejection openings 14*a*.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

The liquid ejection apparatus is not limited to the printer and may be devices such as a facsimile machine and a copying machine. Also, the number of the liquid ejection heads of the liquid ejection apparatus may be any number equal to or more than one. Also, the liquid ejection head is not limited to the line head and may be a serial head. Also, the liquid ejection head may eject any liquid other than the black ink and the pretreatment liquid. Also, the recording medium is not limited to the sheet P and may be any recordable medium.

Each of the capping mechanisms is not limited to have the above-described construction. For example, in a case where the conveyor mechanism includes a belt for conveyance of the sheet P, the capping mechanism may be constituted by the above-described space definer 41 and a conveyor belt. In this configuration, the distal end 41*a* is held in contact with a face of the conveyor belt to define a space between the face and the ejection face such that the space is isolated from the outside space.

Also, the capping mechanism is not limited to be constituted by a plurality of components (such as the space definer 41 and the facing portion 42 in the above-described embodiment and the space definer 41 and the conveyor belt in the above-described modification), and the capping mechanism may be constituted by a single recessed member whose upper face has a recessed portion having substantially the same size as the ejection face, for example. For example, this recessed member includes a space definer and a facing portion provided integrally with each other such that the space definer is provided upright along an edge portion of the facing portion, and this recessed member is not fixed to the liquid ejection head. In this design, the space-definer up/down motor 41M is unnecessary. When this capping mechanism is switched to the defining state, the controller 1*p* moves the platens 5 to the open position, controls the facing-portion up/down motor 42M to elevate the recessed member, and brings a distal end of the space definer into contact with the ejection face 10*x*. Openings respectively for supplying and discharging the humid air into and from the ejection space need to be respectively formed in one end face and the other end face of the space definer in the main scanning direction.

The sense signal output from the temperature and humidity sensor 70 is not limited to be obtained every one minute and may be obtained every suitable length of time. When a length of time from the last obtainment of the sense signal to a start of the next humidifying operation (hereinafter may be referred to as "obtainment waiting time") is shorter than a predetermined length of time, the controller 1*p* may obtain the sense signal also just before the start of the humidifying operation to use a coefficient corresponding to the detected temperature and humidity for the adjustment of the details of the humidifying operation. For example, the controller 1*p* may add, to a cumulative total of values previously obtained, a value calculated by multiplying the obtained coefficient by a ratio of the obtainment waiting time to a time interval of the obtainment.

Instead of the adjustment of the unit-time supply amount, the forcible discharge operation for forcibly discharging the liquid (such as flushing and purging) may be performed. In this configuration, the liquid is consumed, but ejection characteristics of each ejection opening 14*a* can be reliably recovered. For example, in order to reduce the consumption of the liquid, the printer 1 may have two upper limit times such that, when the additional time is equal to or longer than a lower upper limit time and shorter than a higher upper limit time, the controller 1*p* adjusts the supply amount of the humid air, and when the additional time is equal to or longer than the higher upper limit time, the forcible discharge operation is performed.

The tank of the humidifying mechanism may be provided with a heater for heating the humidification liquid. In this configuration, the humid air can be efficiently produced. Also, the humidifying mechanism is not limited to have the structure using the tank for storing the humidification liquid and may have any structure such as a structure employing a mist producer to supply a mist into the ejection space V1 and a structure using other humidification methods such as an ultrasonic method and a heating method. Also, a sensor for detecting the temperature and a sensor for detecting the humidity may be provided independently of each other. Also, a sensor for detecting only one of the temperature and the humidity may be provided.

The controller 1*p* may adjust the next humidifying operation on the basis of only one of the temperature and the humidity. Also, even in the case where the printer 1 includes a plurality of heads respectively configured to eject liquid of different types, the controller 1*p* may not change the adjustment amount for each of the heads. Also, the upper limit time of the additional time may not be provided. Also, the controller 1*p* may adjust only one of the humidification time and the unit-time supply amount for the next humidifying operation. Also, in the case where the humidifying operation is discontinued in response to the receipt of the recording command, the controller 1*p* may adjust the next humidifying operation without consideration of the conveying speed. Also, in the case where the humidifying operation is discontinued in response to the receipt of the recording command, the controller 1*p* may adjust the next humidifying operation on the basis of at least of the temperature and the humidity near the head within a period in which the capping mechanism is kept in the open state.

It is noted that, in the above-described embodiment, when adjusting the supply amount of the humid air for the next humidifying operation, the controller 1*p* increases the humidifying period for the next humidifying operation and the supply amount of the humid air for the next humidifying operation on the basis of the table in FIG. 9. Nevertheless, the present invention is not limited to this configuration. If too much supply air is supplied, a concentration of the liquid near the ejection openings 14*a* may be excessively lowered. Thus, for example, the printer may be configured such that a table storing coefficients including negative values corresponding to a predetermined temperature and a predetermined humidity is provided, and when the humidity near the heads 10*a*, 10*b* becomes excessively high after the discontinuation of the humidifying operation, the controller 1*p* makes the humidification time for the next humidifying operation shorter than the original humidification time and/or makes the supply amount of the humid air for the next humidifying operation smaller than the original supply amount. As a result, the concentration of the liquid near the ejection openings 14*a* can be brought closer to an appropriate value.

Also, in the above-described embodiment, when the preceding humidifying operation is finished at the determined humidification time, the controller 1*p* determines the current humidification time at the predefined length of time (e.g., three minutes), but the present invention is not limited to this configuration. For example, the controller 1*p* may determine the current humidification time on the basis of at least one of the temperature and the humidity detected by the temperature and humidity sensor 70.

Also, in the above-described embodiment, when the capping mechanism 40 is in the defining state, the humidifying mechanism 50 supplies the humid air into the space S1, but the present invention is not limited to this configuration. For example, in a case where the printer 1 is configured such that the humidifying mechanism 50 supplies the humid air into the space S1 when the capping mechanism 40 is in the open state, the controller 1*p* may adjust, when the humidifying operation is discontinued, at least one of the humidification time and the supply amount of the humid air for the next humidifying operation on the basis of at least one of the temperature and the humidity of the temperature and humidity sensor 70.

What is claimed is:

1. A liquid ejection apparatus, comprising:

a liquid ejection head comprising an ejection face that comprises a plurality of ejection openings for ejecting liquid, an ejection space being opposed to the plurality of ejection openings;

a capping mechanism comprising: a facing portion capable of facing the ejection face; and a space definer configured to define the ejection space with the facing portion and the ejection face such that the ejection space is substantially isolated from an outside space, the capping mechanism being switchable between a defining state in which the ejection space is substantially isolated from the outside space and an open state in which the ejection space is open to the outside space;

a humid-air supplier configured to perform a humidifying operation for supplying humid air into the ejection space when the capping mechanism is in the defining state;

a sensor portion configured to sense at least one of temperature and humidity in a vicinity of the liquid ejection head; and a controller configured to control the liquid ejection head, the capping mechanism, and the humid-air supplier, the controller being configured to, when the humidifying operation performed by the humid-air supplier is discontinued, adjust a next humidifying operation based on (i) at least one of the temperature and the humidity each sensed within a period extending from the discontinuation of the humidifying operation to the next humidifying operation, and (ii) a remaining humidification time that is a length of time for which the humid air should have been supplied into the ejection space if the humidifying operation had not been discontinued.

2. The liquid ejection apparatus according to claim 1, wherein the controller is configured to adjust at least one of (i) a humidification time that is a length of time for which the next humidifying operation is performed and (ii) a unit-time supply amount that is an amount of the humid air to be supplied into the ejection space per unit time in the next humidifying operation.

3. The liquid ejection apparatus according to claim 2, wherein the controller is configured to calculate an additional time that is to be added to the next humidifying operation, and the controller is configured to calculate the additional time based on (i) the at least one of the temperature and the humidity sensed within the period and (ii) the remaining humidification time, and wherein the controller is configured to set a humidification time for the next humidifying operation, at a length of time that is obtained by adding the additional time to an original humidification time for the next humidifying operation.

4. The liquid ejection apparatus according to claim 3, wherein the controller is configured to adjust the additional time based on the at least one of the temperature and the humidity sensed within the period.

5. The liquid ejection apparatus according to claim 4, wherein the controller is configured to at least one of: increase the additional time with an increase in the temperature sensed within the period; and increase the additional time with a decrease in the humidity sensed within the period.

6. The liquid ejection apparatus according to claim 3, further comprising a storage device configured to store an upper limit time of the additional time, wherein the controller is configured to, when the additional time is greater than the upper limit time, set the humidification time for the next humidifying operation, at a total time obtained by adding the upper limit time to the original humidification time for the next humidifying operation and set the unit-time supply amount for the next humidifying operation, at a value obtained by adding an original unit-time supply amount for the next humidifying operation to a value obtained by dividing a difference between an amount of the humid air to be supplied within the additional time and an amount of the humid air to be supplied within the upper limit time, by the total time.

7. The liquid ejection apparatus according to claim 2, further comprising a conveyor mechanism configured to convey a recording medium along a conveyance path comprising a recording position opposed to the ejection face, wherein the controller is configured to, when the humidifying operation is discontinued in response to receipt of a recording command, control the liquid ejection head and the conveyor mechanism to perform a recording operation based on the recording command and adjust the next humidifying operation such that at least one of the humidification time and the unit-time supply amount for the next humidifying operation increases with an increase in a speed at which the recording medium is conveyed along the conveyance path in the recording operation.

8. The liquid ejection apparatus according to claim 1, wherein the sensor portion is configured to sense both of the temperature and the humidity, and wherein the controller is configured to adjust the next humidifying operation based on both of the temperature and the humidity sensed within the period.

9. The liquid ejection apparatus according to claim 1, wherein the controller is configured to, when each of a plurality of successive humidifying operations is disconnected, adjust, as the next humidifying operation, a humidifying operation following a last one of the plurality of humidifying operations, based on a cumulative adjustment amount that is a cumulative total of a plurality of adjustment amounts respectively related to a plurality of periods, each as the period, of the plurality of respective humidifying operations.

10. The liquid ejection apparatus according to claim 1, further comprising a plurality of heads each as the liquid ejection head, the plurality of heads being configured to respectively eject liquid of different types, wherein the controller is configured to adjust the next humidifying operation for each of the plurality of heads according to a corresponding one to the different types of the liquid.

11. The liquid ejection apparatus according to claim 1, wherein the humidifying operation is discontinued at least one of when a recording command is received by the controller and when the liquid ejection apparatus is turned off.

* * * * *